US010607830B2

(12) United States Patent
Fu et al.

(10) Patent No.: US 10,607,830 B2
(45) **Date of Patent: *Mar. 31, 2020**

(54) LED LIGHT APPARATUS AND ASSEMBLING METHOD THEREOF

(71) Applicant: XIAMEN ECO LIGHTING CO. LTD., Xiamen (CN)

(72) Inventors: Mingyan Fu, Xiamen (CN); Liangliang Cao, Xiamen (CN); Lilei Su, Xiamen (CN); Dingwei Liang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/199,834

(22) Filed: Nov. 26, 2018

(65) Prior Publication Data

US 2019/0108995 A1 Apr. 11, 2019

Related U.S. Application Data

(63) Continuation of application No. 15/677,985, filed on Aug. 15, 2017, now Pat. No. 10,170,294.

(30) Foreign Application Priority Data

Jun. 5, 2017 (CN) ..... 2017 1 0411351

(51) Int. Cl.

| | |
|---|---|
| ***F21K 9/232*** | (2016.01) |
| ***H01K 1/16*** | (2006.01) |
| ***H01K 1/58*** | (2006.01) |
| ***H01K 3/06*** | (2006.01) |
| ***H01K 3/16*** | (2006.01) |
| ***H01K 5/00*** | (2006.01) |
| ***H01K 1/42*** | (2006.01) |
| ***F21K 9/235*** | (2016.01) |
| ***F21K 9/237*** | (2016.01) |

(52) U.S. Cl.

CPC ..... *H01K 1/16* (2013.01); *F21K 9/232* (2016.08); *F21K 9/235* (2016.08); *F21K 9/237* (2016.08); *H01K 1/42* (2013.01); *H01K 1/58* (2013.01); *H01K 3/06* (2013.01); *H01K 3/16* (2013.01); *H01K 5/00* (2013.01)

(58) Field of Classification Search

None

See application file for complete search history.

(56) References Cited

U.S. PATENT DOCUMENTS 10,170,294 B2 * 1/2019 Fu ..... H01K 1/16
2018/0350584 A1 * 12/2018 Fu ..... H01K 1/16

* cited by examiner

*Primary Examiner* — Christle I Marshall
(74) *Attorney, Agent, or Firm* — Chun-Ming Shih; Lanway IPR Services

(57) ABSTRACT

A conductive structure comprising: a plurality of conductive devices; a first conductive spring sheet, comprising a first connecting point; and a second conductive spring sheet, comprising a second connecting point. Each of the conductive devices comprises a first conductive end and a second conductive end. The second conductive end is connected to the second connecting point, and the first conductive end is connected to the first connecting point corresponding to the second connecting point to which the second conductive end is connected.

20 Claims, 9 Drawing Sheets

LED LIGHT APPARATUS AND ASSEMBLING METHOD THEREOF

BACKGROUND OF THE INVENTION

1. Field of the Invention

The present invention relates to a conductive structure, a lighting fixture and a lighting fixture assembling method, and particularly relates to a conductive structure, a lighting fixture and a lighting fixture assembling method which need no melting.

2. Description of the Prior Art

Conventionally, a lighting fixture always comprises a filament which is melted to a flexible print circuit (FPC), such that the filament can receive electric power and emits light. However, such lighting fixture assembling method is complicated and needs an accurate melting technique, or the filament cannot emit light or even falls off. Besides, if the lighting fixture must be produced via melting, the manufacturer needs expensive equipment and a complicated process, thus the cost for producing a lighting fixture raises.

Additionally, high temperature is generated since the filament generates heat. Accordingly, the filament may be damaged and the yield for the lighting fixture is accordingly affected.

SUMMARY OF THE INVENTION

Therefore, one objective of the present invention is to provide a conductive structure which needs no melting to solve the above-mentioned high cost or high temperature issue.

Another objective of the present invention is to provide a lighting fixture which needs no melting to solve the above-mentioned high cost or high temperature issue.

Another objective of the present invention is to provide a lighting fixture assembling method which needs no melting to solve the above-mentioned high cost or high temperature issue.

One embodiment of the present invention provides a conductive structure, comprising: a plurality of conductive devices; a first conductive spring sheet, comprising a first connecting point; and a second conductive spring sheet, comprising a second connecting point. Each of the conductive devices comprises a first conductive end and a second conductive end. The second conductive end is connected to the second connecting point, and the first conductive end is connected to the first connecting point corresponding to the second connecting point to which the second conductive end is connected.

In one embodiment, the conductive device is strip-shaped, such that the conductive structure can be more stable.

In one embodiment, the conductive device is a filament, such that the conductive structure can be applied for light emitting.

In one embodiment, the second conductive spring sheet comprises an engagement point serving as the second connecting point, such that the efficiency for assembling can be increased.

In one embodiment, a heat dissipation device comprising a first heat dissipation end and a second heat dissipation end is further included. The first conductive spring sheet is provided at the first heat dissipation end and the second conductive spring sheet is provided at the second heat dissipation end. By this way the conductive structure can have a better heat dissipation ability.

In one embodiment, the heat dissipation device is column-shaped, such that the whole structure can be more stable.

In one embodiment, the first conductive spring sheet comprises a bending part and the heat dissipation device comprises an opening; a shape of the bending part corresponds to the opening; the bending part is through the opening and contacts the conductive device. By this way, the assembling can be more convenient.

In another embodiment, a lighting fixture is provided, which comprises: a light bulb; a filament; a first conductive spring sheet, comprising a first connecting point; and a second conductive spring sheet, provided in the light bulb, comprising a second connecting point. Each of the filaments comprises a first filament end and a second filament end. The second filament end is connected to the second connecting point, and the first filament end is connected to the first connecting point corresponding to the second connecting point to which the second filament end is connected.

In one embodiment, the filament is strip-shaped, thereby the lighting fixture can be more stable.

In one embodiment, a lamp cap is further included, wherein the first conductive spring sheet is provided in the lamp cap. By this way, the lighting fixture can be more stable.

In one embodiment, the second conductive spring sheet comprises an engagement point serving as the second connecting point. By this way, the convenience for assembling increases.

In one embodiment, a heat dissipation device comprising a first heat dissipation end and a second heat dissipation end is further provided. The first conductive sheet is provided at the first heat dissipation end and the second conductive sheet is provided at the second heat dissipation end. By this way, the lighting fixture has higher heat dissipation ability.

In one embodiment, the heat dissipation device is column-shaped, thereby the whole structure can be more stable.

In one embodiment, the second heat dissipation end abuts the light bulb, such that the whole structure can be more stable and the heat dissipation ability is higher.

In one embodiment, the light bulb and the heat dissipation device comprises openings. By this way, the lighting fixture has higher heat dissipation ability.

In one embodiment, the first conductive sheet comprises a bending part and the heat dissipation device comprises an opening; a shape of the bending part corresponds to the opening; and the bending part is through the opening and contacts the filament. By this way, the assembling can be more convenient.

One embodiment of the present invention provides a lighting fixture assembling method, which comprises: (a) providing a first conductive spring sheet to a first heat dissipation end of a heat dissipation device; (b) assembling the first heat dissipation end to a lamp cap; (c) providing a second conductive spring sheet to a second heat dissipation end of the heat dissipation device; (d) providing at least one filament to closely contact the heat dissipation device, to insert the filament to the first conductive spring sheet and the second conductive spring sheet; and (e) assembling the lamp cap and a light bulb, thereby the heat dissipation device and the second conductive spring sheet are provided in the light bulb.

In one embodiment, the step (e) comprises abutting the second heat dissipation end to the light bulb. By this way, the whole structure can be more stable and the heat dissipation ability is higher.

In one embodiment, the light bulb and the heat dissipation device comprises openings. By this way, the lighting fixture has higher heat dissipation ability.

In one embodiment, the first conductive sheet comprises a bending part and the heat dissipation device comprises an opening; a shape of the bending part corresponds to the opening; the step (d) comprising inserting the bending part through the opening. In another embodiment, the step (d) comprising holding the bending part between the heat dissipation device and the lamp cap. By this way, the assembling can be more convenient.

It is noted that the number and the arrangement for the components are not limited to above-mentioned embodiments.

For more detail, in the above-mentioned embodiments, the lighting fixture or the conductive structure thereof can be manufactured without being welted, such that the conventional problems that professional equipment and more complicated process are needed can be solved.

In addition, the filament closely contacts the heat dissipation device, such that the heat generated by the filament can be effectively removed by the heat dissipation device. Moreover, the lighting fixture assembling method provided by the present invention can more efficiently assemble the lighting fixture. Accordingly, comparing with the conventional techniques, the conductive structure, the lighting fixture and the lighting fixture assembling method have following advantages: low cost, high heat dissipation ability or the efficiency for assembling.

DETAILED DESCRIPTION

Figure 1:
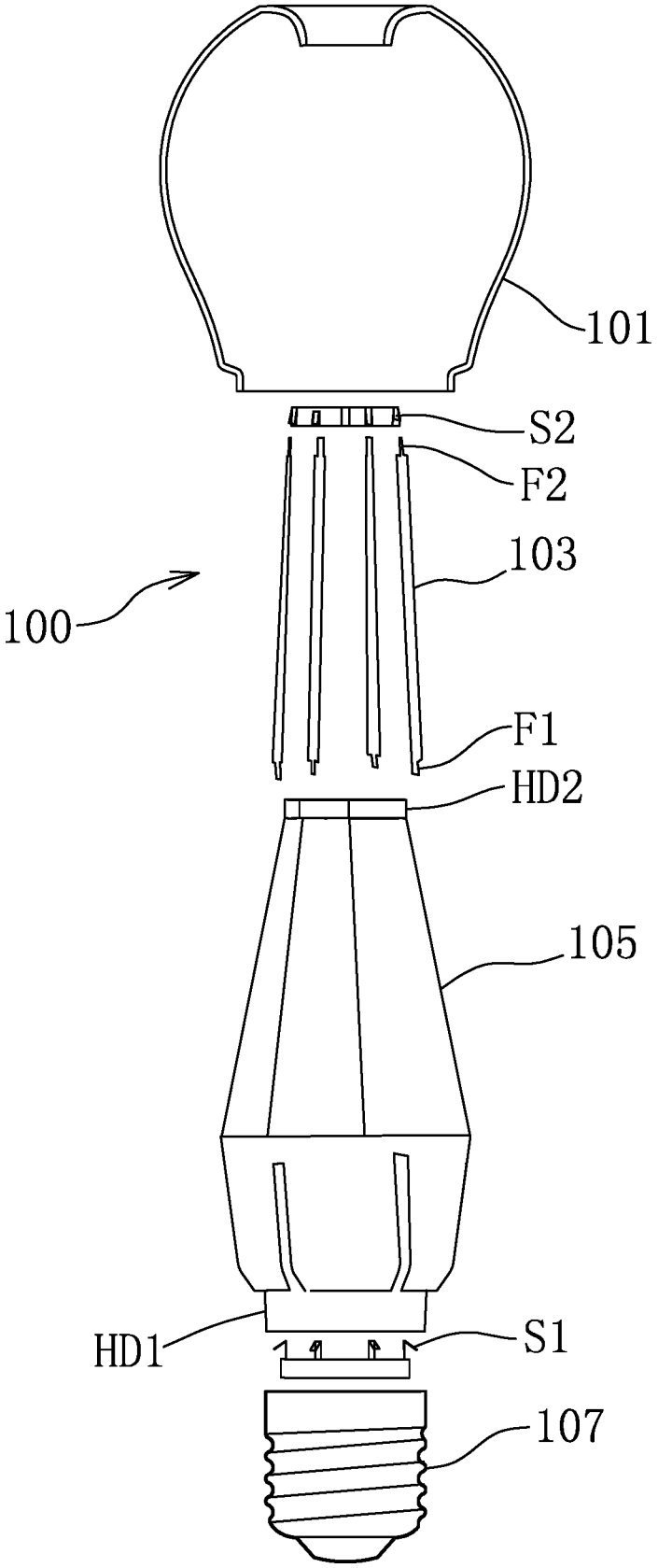
FIG. 1 is an exploded diagram for a lighting fixture according to one embodiment of the present invention.

FIG. 1 is an exploded diagram for a lighting fixture according to one embodiment of the present invention. As illustrated in FIG. 1, the lighting fixture 100 comprises a light bulb 101, a plurality of filaments 103, a first conductive spring sheet S1, a second conductive spring sheet S2, and a heat dissipation device 105. The filament 103 contacts the heat dissipation device 105. In one embodiment, the filament 103 is stripe-shaped and is in close contact with the heat dissipation device 105, but is not limited thereto. Each filament 103 comprises a first filament end F1 and a second filament end F2. The first filament end F1 is connected to the first connection point of the first conductive spring sheet S1 and the second filament end F2 is connected to the corresponding second conductive point of the second conductive string sheet S2. Detail structures will be described below. The heat dissipation device 105 is columnar-shaped in this embodiment and includes a first heat dissipation end HD1 and a second heat dissipation end HD2. Also, the first conductive string sheet S1 is provided at the first heat radiating end HD1, and the second conductive string sheet S2 is provided on the second heat dissipation end HD2. The second heat dissipation end HD2 is provided in the light bulb 101. In one embodiment, the lighting fixture 100 further includes a lamp cap 107, and the first heat dissipation end HD1 is located in the lamp cap 107. In addition, in one embodiment, the lighting fixture 100 also includes a driver for providing power to the filament 103, which is disposed in the lamp cap 107, but is not shown in FIG. 1. After the assembling is completed, if the electric power is supplied to the lamp cap 107, the filament 103 receives electric power via the first conductive string sheet S1 and the second conductive string sheet S2, thereby emits light. In some embodiments, the filament 103 is a light strip having a plurality of light emitting diodes.

The filament 103, the first conductive string sheet S1 and the second conductive string sheet S2 can be made from conductive material, for example, metal. Besides, the heat dissipation device 105 can be made from material that can dissipate heat such as metal. However, the materials for the filament 103, the first conductive string sheet S1 and the second conductive string sheet S2 are not limited to metal.

Please also note that the shape and number of the components in FIG. 1 are only for illustrating and do not mean to limit the present invention. For example, the light bulb 101 may have other shapes (e.g., cylindrical), the heat dissipation device 105 may be rectangular or cylindrical, and the number of filaments 103 may be different from that of FIG. 1. Also, the shapes and the locations for the first conductive spring sheet S1 and the second conductive spring sheet S2 may be different depending on the shapes of the light bulb 101 and the light dissipation device 105.

Figure 2:
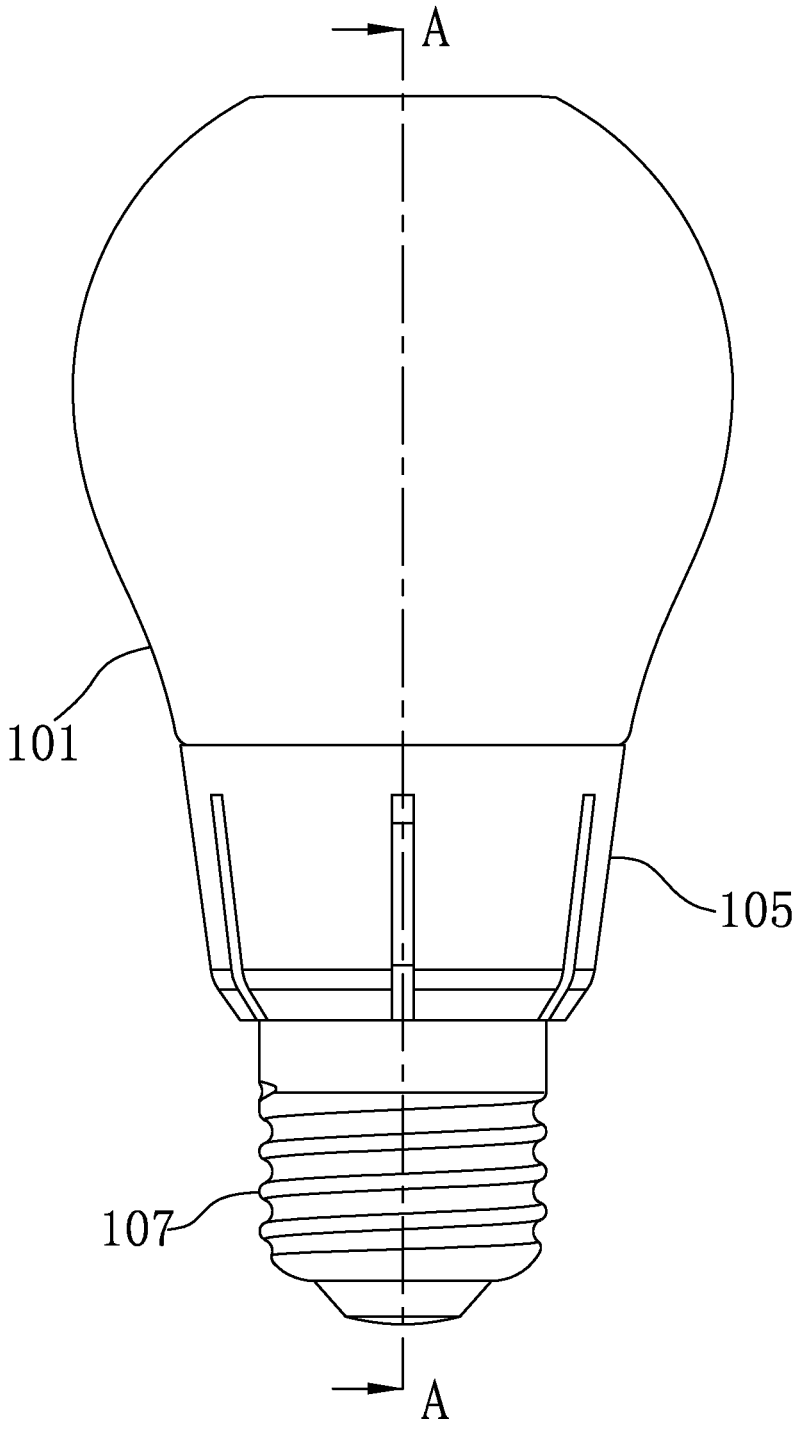
FIG. 2 is a schematic diagram illustrating an outline for a lighting fixture according to one embodiment of the present invention.
Figure 3:
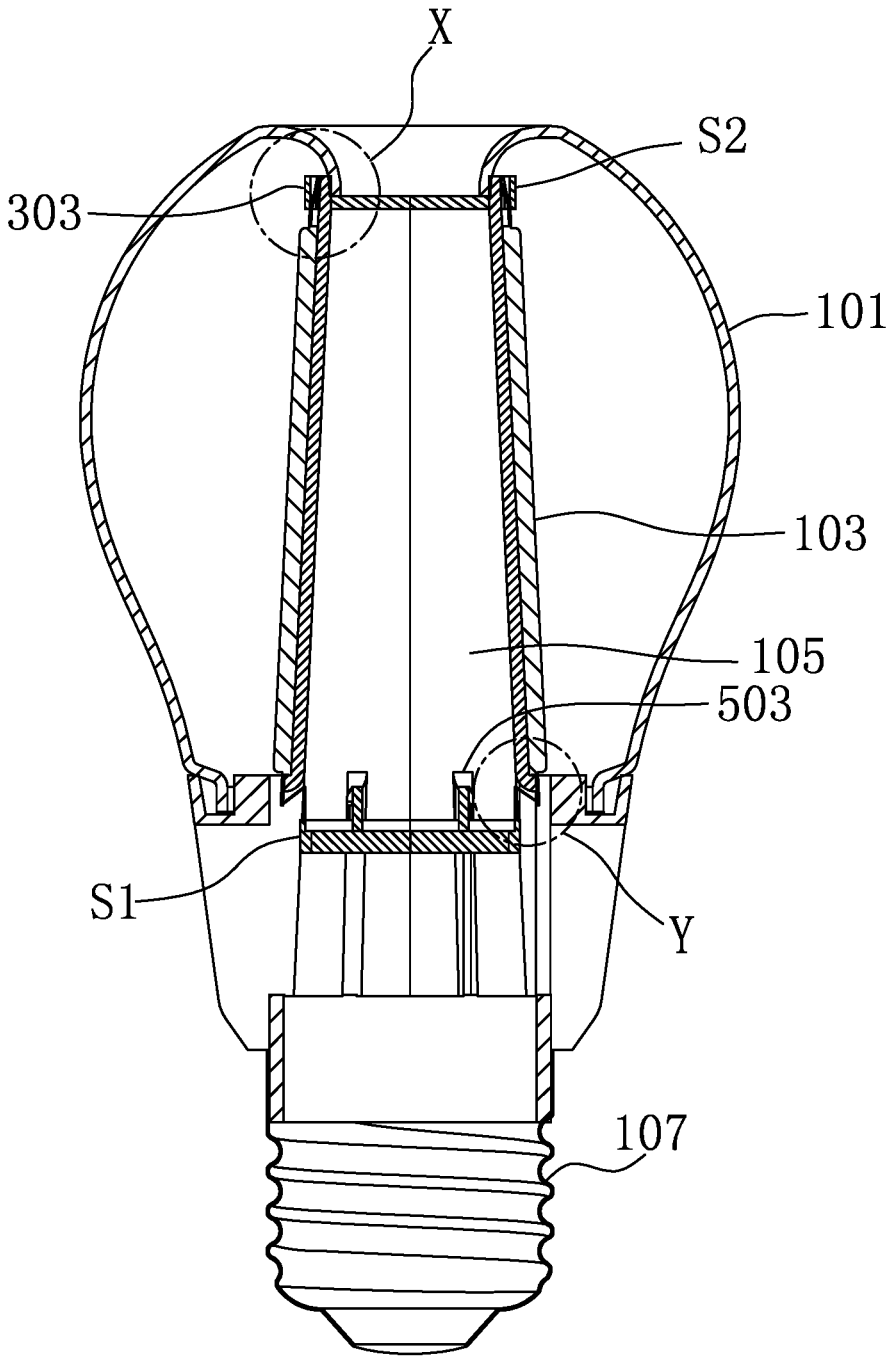
FIG. 3 is a cross-sectional view following the A direction in FIG. 2.

FIG. 2 is a schematic diagram illustrating an outline for a lighting fixture according to one embodiment of the present invention. As illustrated in FIG. 2, a portion of the heat dissipation device 105 may be provided in the light bulb 101 and another portion of the heat dissipation device 105 may be provided in the lamp cap 107. FIG. 3 is a cross-sectional view of a lighting fixture according to an embodiment of the present invention. For more detail, FIG. 3 is a cross-sectional view following the A direction in FIG. 2. As shown in FIG. 3, the first conductive string sheet S1 and the second conductive string sheet S2 are provided at the first heat dissipation end HD1 and the second heat dissipation end HD2 of the heat dissipation device 105, respectively. In one embodiment, the heat dissipation device 105 has an opening 503, through which the first conductive string sheet S1 is fastened to the heat dissipation device 105. The opening 503 is the aforementioned first heat dissipation end HD1. In addition, the second conductive spring sheet S2 is socketed to the second heat dissipation end HD2 of the heat dissipation device 105 (not shown in FIG. 3), and the second heat dissipation end HD2 of the heat dissipation device 105 abuts the light bulb 101. By allowing the second heat dissipation terminal to abut the light bulb 101, not only the second conductive spring sheet S2 can be fixed to the heat dissipation device 105, but also the filament 103 can dissipate heat via the heat dissipation device 105 more effectively. For more detail, the heat dissipation device 105 can dissipate heat to the light bulb 101, to enhance the effect of heat dissipation. In one embodiment, both the light bulb 101 and the heat dissipation device 105 contain openings (not shown), which can further enhance the effect of heat dissipation.

Figure 4:
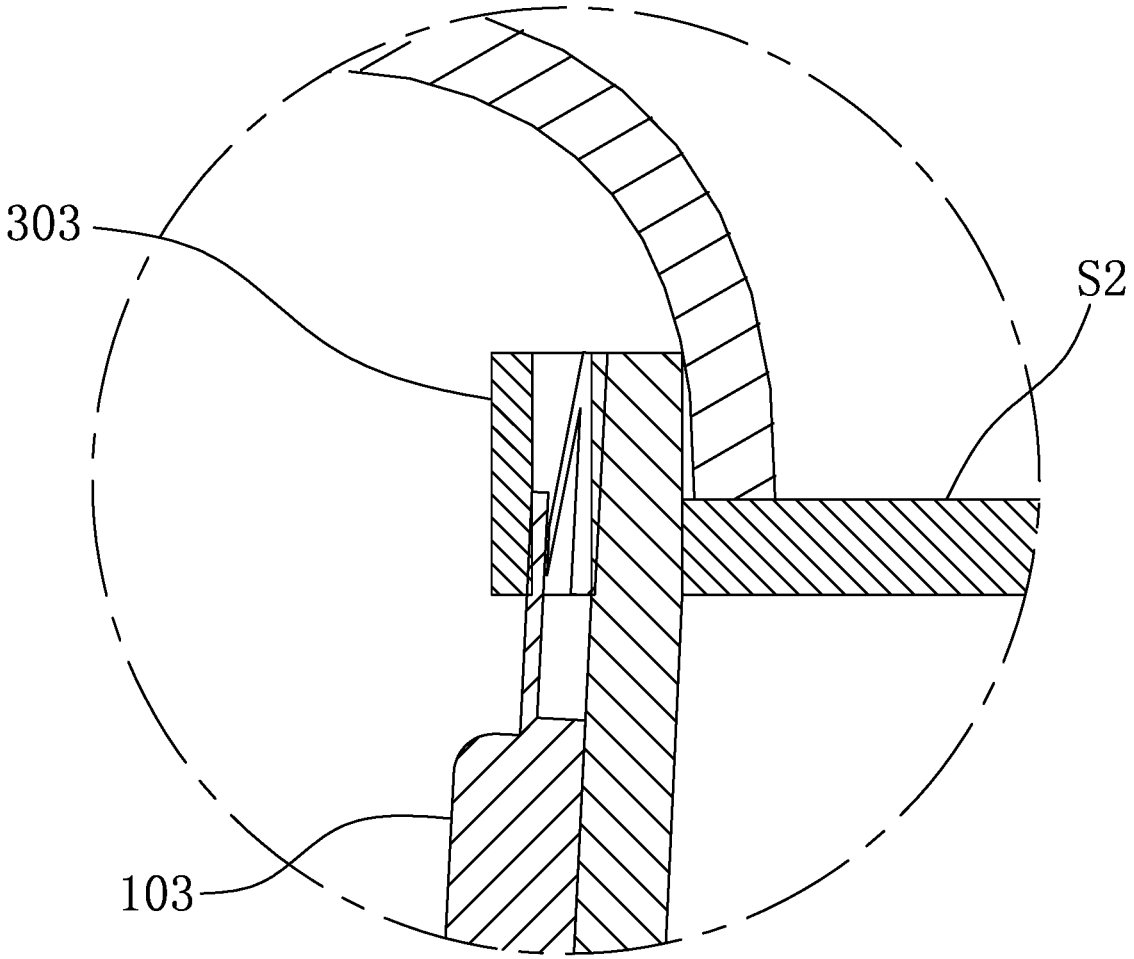
FIG. 4 and FIG. 5 are enlarged diagrams for the X part and the Y part in FIG. 3.
Figure 5:
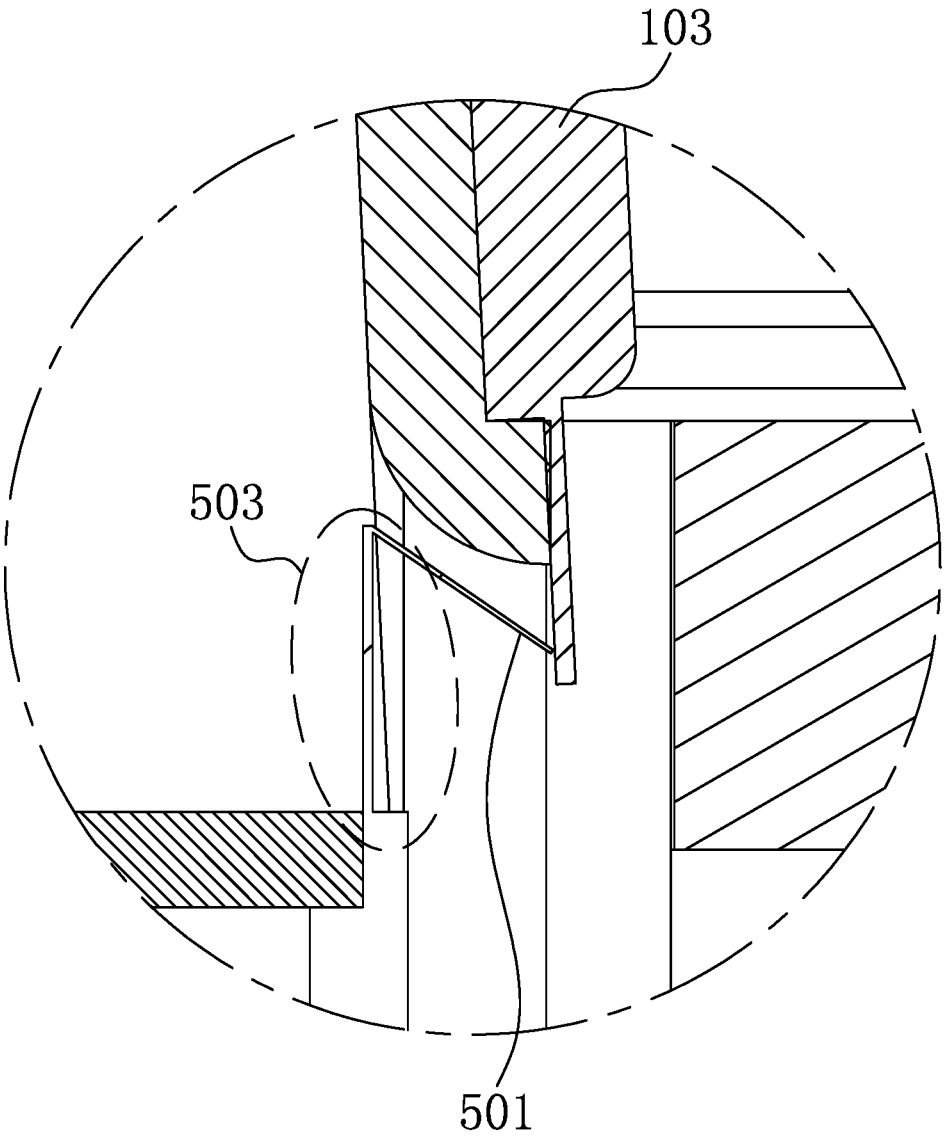

FIG. 4 and FIG. 5 are enlarged diagrams for a portion of the embodiment illustrated in FIG. 3. More specifically, FIG. 4 and FIG. 5 are enlarged diagrams for the X part and the Y part in FIG. 3. Please refer to FIG. 3, FIG. 4 and FIG. 5 to understand the concept of the present invention for more clear. It should be noted that the structures in FIG. 4, FIG. 5 are only for example. Any structure that can provide the functions of FIG. 4, FIG. 5 should fall in the scope of the present invention.

As illustrated in FIG. 4, the second conductive spring sheet S2 comprises an engagement point 303 served as the aforementioned second connecting end. The second filament end of the filament 103 can be engaged to the engagement point 303 and fixed to the second conductive spring sheet S2. Additionally, as illustrated in FIG. 5, the first conductive spring sheet S1 comprises a bending part 501 and the heat dissipation device 105 comprises an opening 503. A shape of the bending part 501 corresponds to the opening 503, and the bending part 501 is through the opening 503 and contacts the first conductive spring sheet S1. By this way, the filament 103 can be electrically connected to the first conductive spring sheet S1, and the bending part 501 can be hold and fixed between the heat dissipation device 105 and the lamp cap 107.

Based upon above-mentioned embodiments, the filament 103 can be connected to the first conductive spring sheet S1 and the second conductive spring sheet S2 via a mechanical mechanism rather than then the conventional method which melts the filament to the FPC, thus the conventional disadvantage that more professional employers and more professional equipment's are needed, can be solved. Besides, the filament closely contacts the heat dissipation device, thus the heat generated by the filament 103 can be effectively dissipated by the heat dissipation device.

Please note, the method for providing the first conductive spring sheet S1 and the second conductive spring sheet S2 to the heat dissipation device 105 can be different from which in FIG. 3. For example, the second conductive spring sheet S2 can be engaged to the heat dissipation device 105 and the first conductive spring sheet S1 can be socked to the heat dissipation device 105. After that, the components can be fixed via abutting the lamp cap 107. In another embodiment, the heat dissipation device 105 does not comprise any opening, and the filament 103 can be inserted to the opening of the first conductive spring sheet S1 following the heat dissipation device 105. In short, any method or structure which can fix the first conductive spring sheet S1 and the second conductive spring sheet S2 to the heat dissipation device 105, and can fix the heat dissipation device 105 between the light bulb 101 and the light cap 107, should fall in the scope of the present invention.

Figure 6:
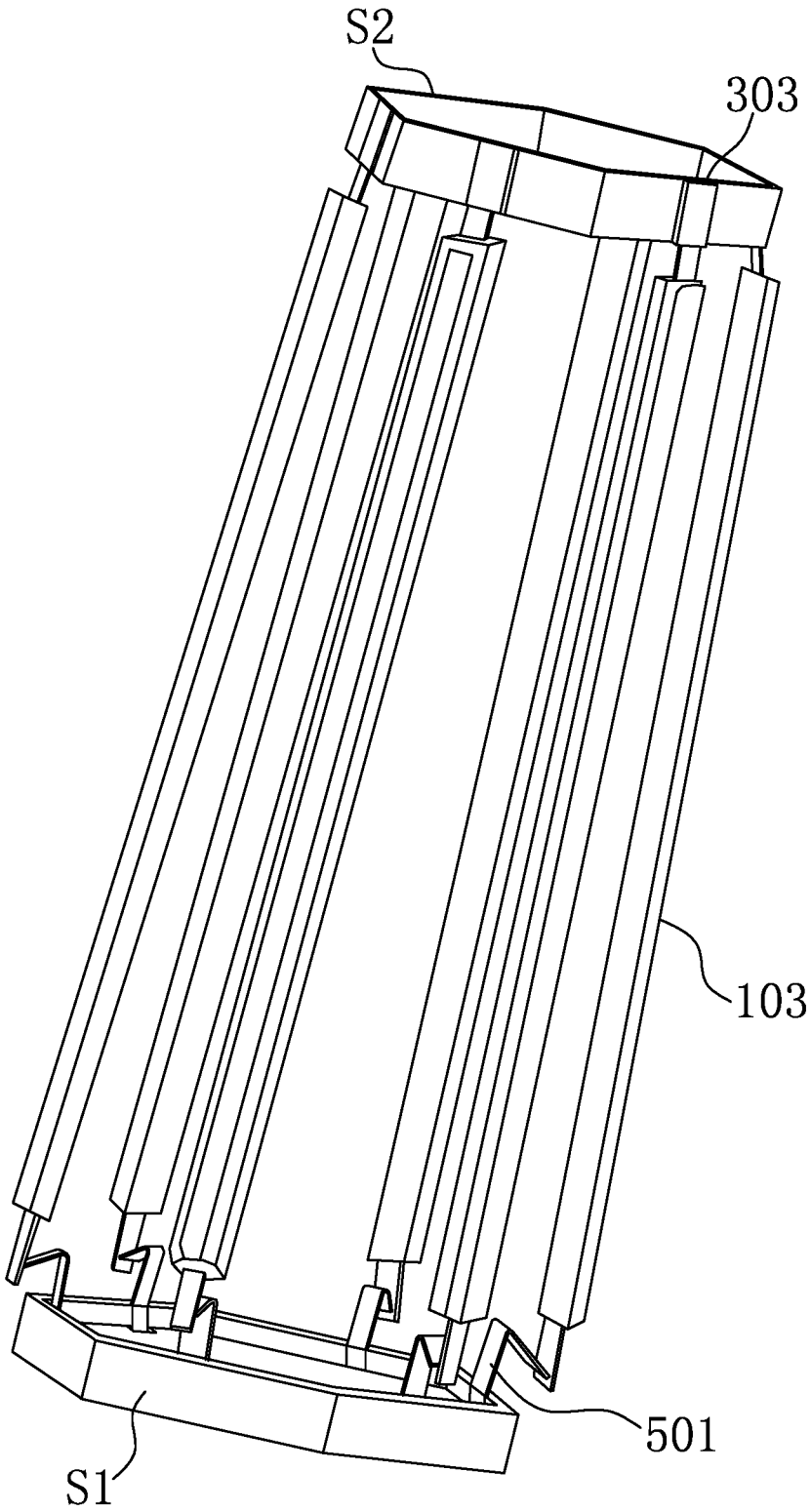
FIG. 6 is a schematic diagram illustrating an assembling for a first conductive spring sheet, a second conductive spring sheet, and a filament according to one embodiment of the present invention.

In following descriptions, more figures with different aspects are provided to explain the component in FIG. 1. FIG. 6 is a schematic diagram illustrating the first conductive spring sheet S1, the second conductive spring sheet S2 and the filament 103 in FIG. 1. Based on FIG. 6, it can be clearly understood how the second filament end of the filament 103 is engaged to the engagement point 303, and how the bending part 501 of the first conductive spring sheet S1 contacts the filament 103. In one embodiment, the lighting fixture 100 in FIG. 1 does not comprise the heat dissipation device 105 and only comprises the first conductive spring sheet S1, the second conductive spring sheet S2 and the filament 103 in FIG. 6. Such embodiment can be summarized as: A lighting fixture, comprising: a light bulb (ex. 101 in FIG. 1); a filament(ex. 103 in FIG. 1); a first conductive spring sheet (ex. S1 in FIG. 1), comprising a first connecting point; and a second conductive spring sheet (ex. S2 in FIG. 1), provided in the light bulb, comprising a second connecting point; wherein each of the filaments comprises a first filament end and a second filament end; wherein the second filament end is connected to the second connecting point, and the first filament end is connected to the first connecting point corresponding to the second connecting point to which the second filament end is connected. In one embodiment, the filament has a high hardness, such that the structure formed by the first conductive spring sheet S1, the second conductive spring sheet S2 and the filament 103 can still be stable even if the heat dissipation device does not exist.

Additionally, the structure in FIG. 6 can be regarded as a conductive structure, which can be applied to a lighting fixture and any other equipment besides the lighting fixture. Such embodiment can be summarized as: A conductive structure, comprising: a plurality of conductive devices (ex. the filament 103); a first conductive spring sheet (ex. S1 in FIG. 1, FIG. 6), comprising a first connecting point; and a second conductive spring sheet(ex. S2 in FIG. 1, FIG. 6), comprising a second connecting point; wherein each of the conductive devices comprises a first conductive end and a second conductive end; wherein the second conductive end is connected to the second connecting point, and the first conductive end is connected to the first connecting point corresponding to the second connecting point to which the second conductive end is connected.

In one embodiment, the conductive devices are stripe-shaped. In one embodiment, the second conductive string sheet comprises an engagement point served as the above-mentioned second connecting point, such as the embodiment in FIG. 4. In one embodiment, the conductive structure further comprises a heat dissipation device (ex. 105 in FIG. 1) comprising a first heat dissipation end and a second heat dissipation end. The first conductive spring sheet is provided at the first heat dissipation end and the second conductive spring sheet is provided at the second heat dissipation end. In one embodiment, the heat dissipation device is column-shaped. In one embodiment, the first conductive spring sheet S1 comprises a bending part (ex. 501 in FIG. 5), which is electrically connected to a first conductive end of the conductive device (ex. the filament 103). In such embodiment, no heat dissipation device exists, thus the bending part can be changed to a structure which can be more easily fixed to the filament. For example, the bending part can be changed to a hollow ring, such that the filament can be fixed via passing through the hollow ring. Such variation should also fall in the scope of the present invention.

Figure 7:
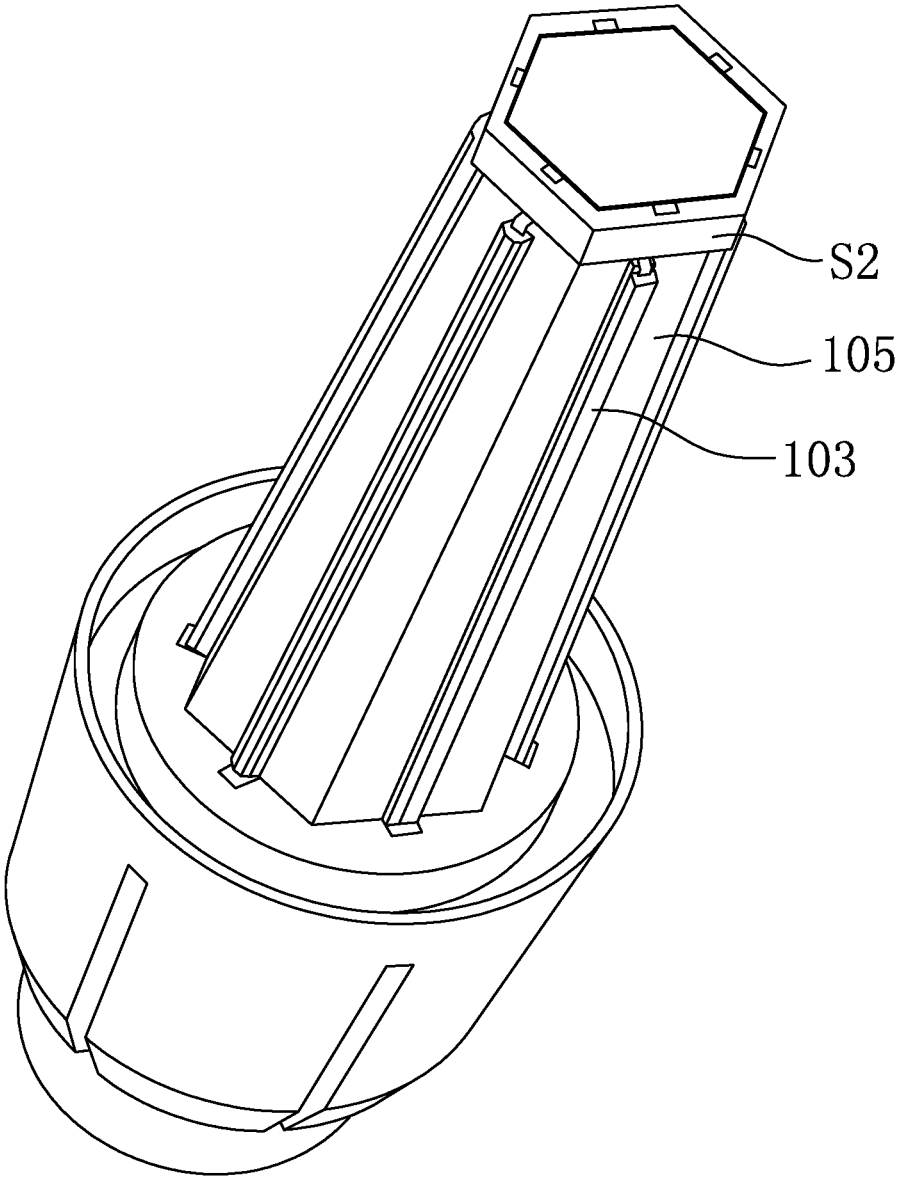
FIG. 7 is a schematic diagram illustrating an assembling for a first conductive spring sheet, a second conductive spring sheet, a filament and a heat dissipation device according to one embodiment of the present invention.
Figure 8:
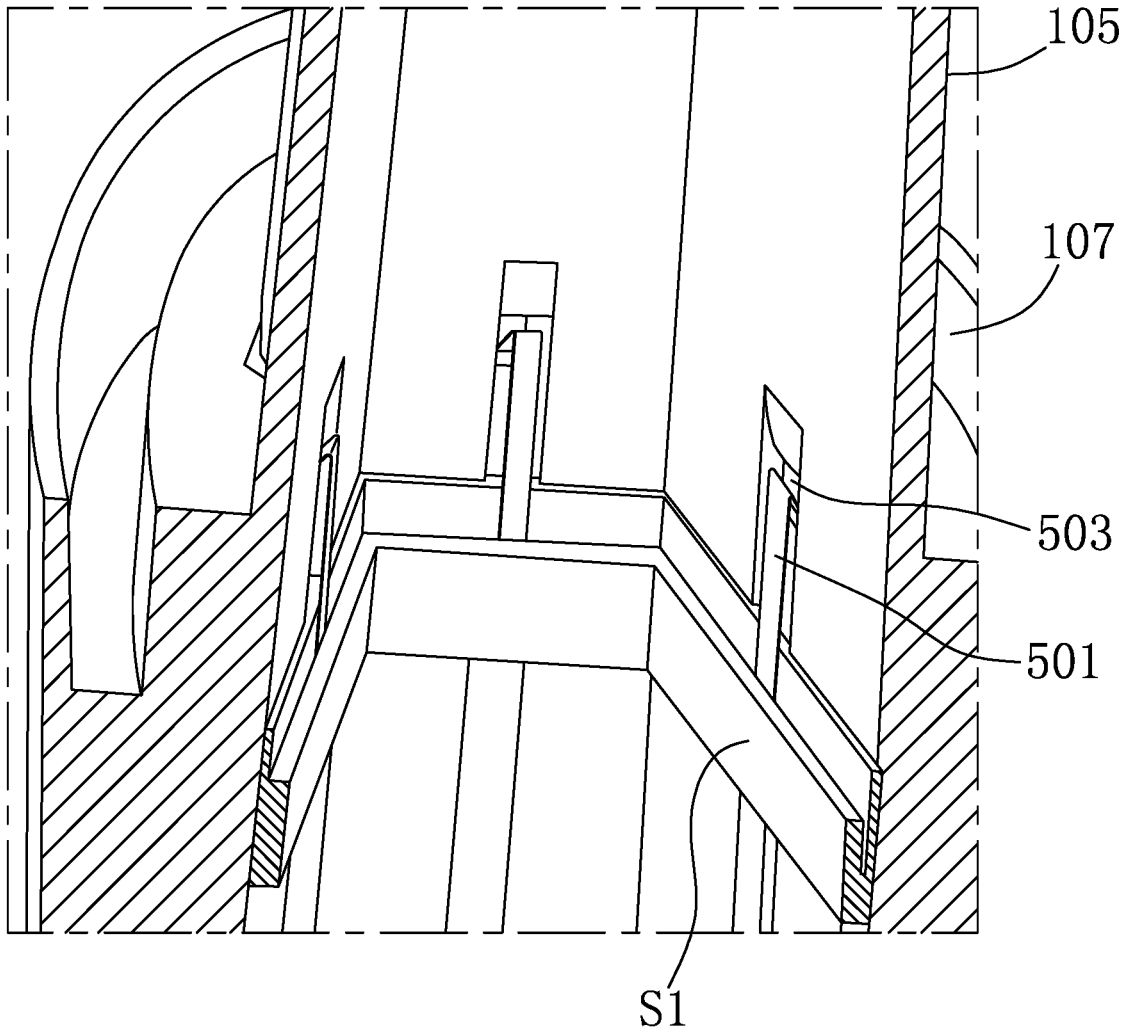
FIG. 8 is a schematic diagram illustrating an assembling for a first conductive spring sheet, a filament and a heat dissipation device according to one embodiment of the present invention.

FIG. 7 is a schematic diagram illustrating an assembling for a first conductive spring sheet S1, a second conductive spring sheet S2, a filament 103 and a heat dissipation device 105 according to one embodiment of the present invention. As illustrated in FIG. 7, the second filament end of the filament 103 is engaged to the above-mentioned engagement point 303, and the filament 103 closely contacts the heat dissipation device 105. Also, the first filament terminal of the filament 103 is inserted into the heat dissipation device 105. Besides, as illustrated in FIG. 8, the bending part 501 is through the opening 503 of the heat dissipation device 105 and contacts the filament 103, as illustrated in FIG. 5. Please note, some details are not illustrated in FIG. 7 for the convenient of understanding.

Figure 9:
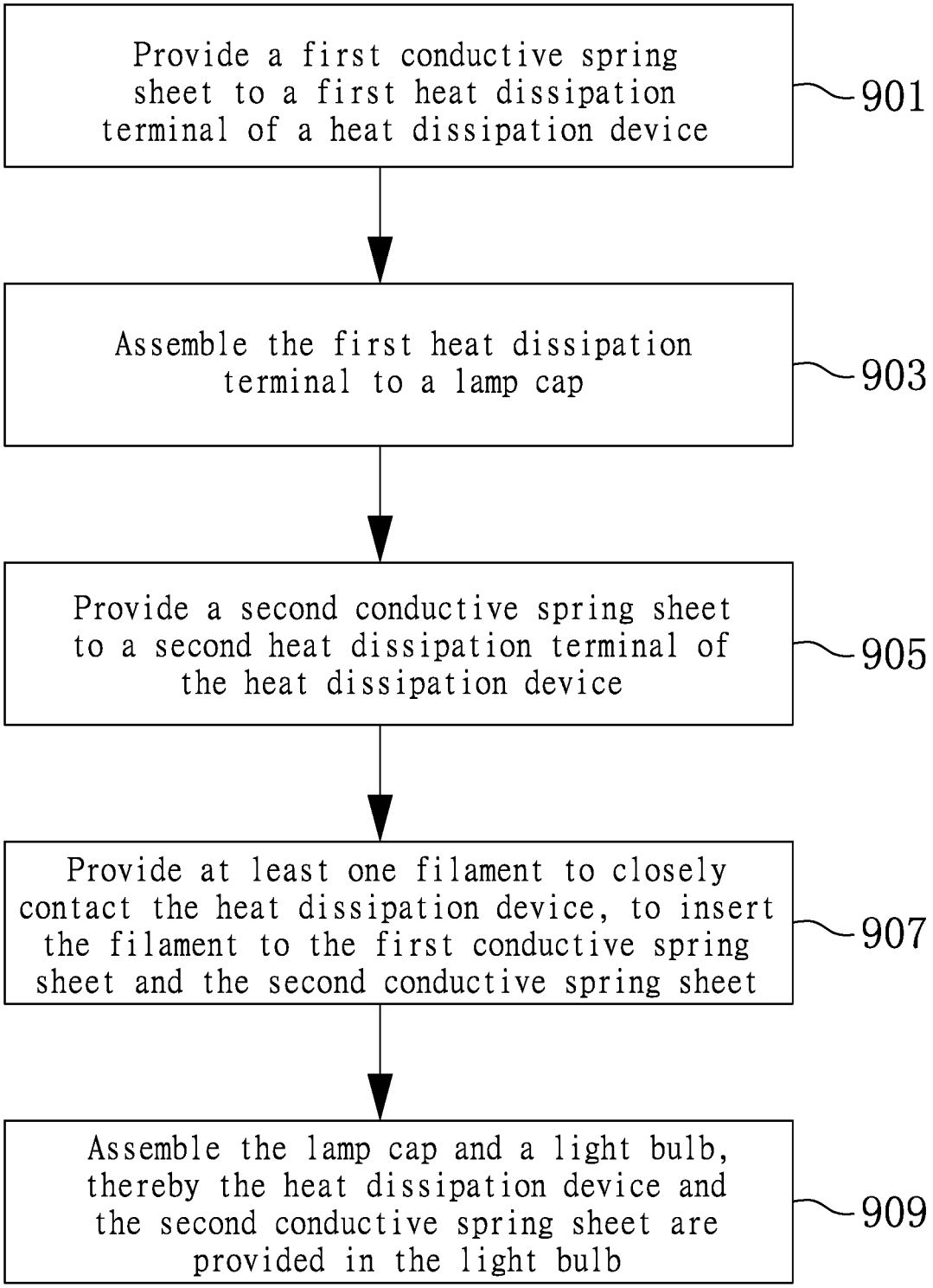
FIG. 9 is a schematic diagram illustrating a lighting fixture assembling method according to one embodiment of the present invention.

FIG. 9 is a schematic diagram illustrating a lighting fixture assembling method according to one embodiment of the present invention, which comprises following steps:

Step 901

Provide a first conductive spring sheet (ex. S1 in FIG. 1)to a first heat dissipation terminal of a heat dissipation device (ex. 105 in FIG. 1).

Step 903

Assemble the first heat dissipation terminal to a lamp cap (ex. 107 in FIG. 1).

Step 905

Provide a second conductive spring sheet (ex. S2 in FIG. 1) to a second heat dissipation terminal of the heat dissipation device.

Step 907

Provide at least one filament to closely contact the heat dissipation device, to insert the filament to the first conductive spring sheet and the second conductive spring sheet. For example, via the structures in FIG. 4 and FIG. 5.

Step 909

Assemble the lamp cap and a light bulb, thereby the heat dissipation device and the second conductive spring sheet are provided in the light bulb.

In one embodiment, the step 909 further comprises abutting the second heat dissipation end of the heat dissipation device to the light bulb, as illustrated in FIG. 3. In one embodiments, steps for providing openings to the light bulb and the heat dissipation device are further included. In one embodiment, the first conductive sheet comprises a bending part and the heat dissipation device comprises an opening, and the bending part is through the opening and contacts the filament. The step 907 further comprises inserting the bending part through the opening, as illustrated in FIG. 3 and FIG. 5. In one embodiment, the step 907 comprises holding the wending part between the heat dissipation device and the lamp cap, as illustrated in FIG. 3 and FIG. 5.

Based on the steps shown in FIG. 9, the lighting fixture provided by the present invention can be assembled easily and quickly. It is noted that the lighting fixture provided by the present invention is not limited to be assembled by the steps shown in FIG. 9. For example, the second conductive string sheet may be firstly inserted into the light bulb and fixed, and then the heat dissipation device is inserted into the second conductive string sheet in the light bulb.

According to the foregoing embodiments, the lighting fixture or the conductive structure thereof can be manufactured without being welded. Such method can solve the conventional problem that professional equipment and professional employers are needed. In addition, the filament closely contacts the heat dissipation device, such that the heat generated by the filament can be effectively removed by the heat dissipation device. Moreover, the lighting fixture assembling method provided by the present invention can more efficiently assemble the lighting fixture.

According to the above-described embodiments, the conventional problem for the high cost or high temperature can be solved according to different technical characteristics. For more detail, based on the above-mentioned embodiments, the lighting fixture or the conductive structure thereof can be manufactured without being welted, such that the conventional problems that professional equipment and more complicated process are needed can be solved. In addition, the filament closely contacts the heat dissipation device, such that the heat generated by the filament can be effectively removed by the heat dissipation device. Moreover, the lighting fixture assembling method provided by the present invention can more efficiently assemble the lighting fixture. Accordingly, compared with the conventional techniques, the conductive structure, the lighting fixture and the lighting fixture assembling method have following advantages: low cost, high heat dissipation ability or the efficiency for assembling.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A LED light apparatus, comprising:

a first conductive base, comprising multiple first connecting points;

a second conductive base, comprising multiple second connecting points; and multiple filaments, each filament having a first elastic hook to be fixed to the first connecting point and having a second elastic hook to be fixed to the second connecting point so as to keep the multiple filaments spreading as a three-dimensional light source.

2. The LED light apparatus of claim 1, wherein the conductive device is strip-shaped.

3. The LED light apparatus of claim 1, wherein the first conductive base and the second conductive have conductive paths for electrically connecting the filaments.

4. The LED light apparatus of claim 1, wherein the filaments are evenly distributed with respect to the first connecting base and the second connecting base.

5. The LED light apparatus of claim 1, further comprising a heat dissipation device comprising a first heat dissipation end and a second heat dissipation end, wherein a first conductive spring sheet is provided at the first heat dissipation end and the second conductive spring sheet is provided at the second heat dissipation end.

6. The LED light apparatus of claim 5, wherein the heat dissipation device is column-shaped.

7. The LED light apparatus of claim 5, wherein the first conductive spring sheet comprises a bending part and the heat dissipation device comprises an opening;

wherein a shape of the bending part corresponds to the opening;

wherein the bending part is through the opening and contacts the conductive device.

8. A LED light apparatus, comprising:

a light bulb;

multiple filaments;

a first conductive support, comprising multiple first connecting points; and a second conductive support, provided in the light bulb, comprising multiple second connecting points;

wherein each of the filaments comprises a first filament end and a second filament end;

wherein the second filament end of each filament is connected to one of the second connecting points, and the first filament end of each filament is connected to one of the first connecting points corresponding to the second connecting.

9. The LED light apparatus of claim 8, wherein the filament is a strip-shaped LED device.

10. The lighting fixture of claim 8, further comprising a lamp cap, wherein the first conductive base is fixed the lamp cap.

11. The LED light apparatus of claim 8, wherein the second conductive base is a geometrical structure with multiple connecting points on the geometrical structure to distribute the second connecting points so as the second connecting points are spaced with a predetermined distance.

12. The LED light apparatus of claim 8, further comprising a heat dissipation device comprising a first heat dissipation end and a second heat dissipation end, wherein the first conductive sheet is provided at the first heat dissipation end and the second conductive sheet is provided at the second heat dissipation end.

13. The LED light apparatus of claim 12, wherein the heat dissipation device is column-shaped.

14. The LED light apparatus of claim 8, wherein the filaments are together located as a cone shape structure.

15. The LED light apparatus of claim 8, wherein there are predetermined distances between two adjacent filaments by spreading the filaments in a three-dimensional space with the first conductive support and the second conductive support.

16. The lighting fixture of claim 12, wherein the first conductive sheet comprises a bending part and the heat dissipation device comprises an opening;

wherein a shape of the bending part corresponds to the opening;

wherein the bending part is through the opening and contacts the filament.

17. The lighting fixture of claim 16, further comprising a lamp cap, wherein the wending part is held between the heat dissipation device and the lamp cap.

18. A method for assembling a LED light device assembling method, comprising:

(a) providing a first conductive spring sheet to a first heat dissipation end of a heat dissipation device;

(b) assembling the first heat dissipation end to a lamp cap;

(c) providing a second conductive spring sheet to a second heat dissipation end of the heat dissipation device;

(d) providing at least one filament to closely contact the heat dissipation device, to insert the filament to the first conductive spring sheet and the second conductive spring sheet; and (e) assembling the lamp cap and a light bulb, thereby the heat dissipation device and the second conductive spring sheet are provided in the light bulb.

19. The method of claim 18, wherein the first conductive sheet comprises a bending part and the heat dissipation device comprises an opening;

wherein a shape of the bending part corresponds to the opening;

wherein the step (d) comprising inserting the bending part through the opening.

20. The method of claim 19, wherein the step (d) comprising holding the wending part between the heat dissipation device and the lamp cap.

* * * * *